United States Patent [19]

Kissell et al.

[11] 4,358,160

[45] Nov. 9, 1982

[54] AIR DIVERSION AND DUST CONTROL SYSTEM FOR LONGWALL SHEARERS

[75] Inventors: Fred N. Kissell, Pittsburgh, Pa.; Terry L. Muldoon, Walpole, Mass.; William E. Schroeder, Jr., Belmont, Mass.; Carl R. Peterson, Boxford, Mass.

[73] Assignee: The United States of America as represented by the Secretary of the Interior, Washington, D.C.

[21] Appl. No.: 251,404

[22] Filed: Apr. 6, 1981

[51] Int. Cl.[3] ..... E21C 35/20

[52] U.S. Cl. ..... 299/43; 98/50; 299/12

[58] Field of Search ..... 299/12, 43, 64, 81; 98/50

[56] References Cited

U.S. PATENT DOCUMENTS

| | | | |
|---|---|---|---|
| 3,700,284 | 10/1972 | Agnew | 299/46 |
| 3,861,751 | 1/1975 | Erwien | 299/43 |
| 4,157,204 | 6/1979 | Kissell et al. | 299/64 |
| 4,315,658 | 2/1982 | French et al. | 299/12 X |

*Primary Examiner*—Ernest R. Purser

*Attorney, Agent, or Firm*—Donald A. Gardiner; Ronald C. Williams

[57] ABSTRACT

An air diversion and dust control system for primary use on longwall shearer mining machinery, consisting of directional fluid sprays and passive curtain barriers. The air moving characteristics of fluid sprays are combined with the splitting and blocking characteristics of passive curtain barriers in order to produce an air stream splitting and diversion system which acts to keep dust away from the breathing zone of the machine operator and contained in the area of the coal face until beyond the mining machine. The fluid sprays have a double function in that they both divert and suppress the dust generated during the cutting operation.

6 Claims, 2 Drawing Figures

AIR DIVERSION AND DUST CONTROL SYSTEM FOR LONGWALL SHEARERS

BACKGROUND OF THE INVENTION

1. Field of the Invention

The invention disclosed herein is a ventilation, air diversion, and dust control system for primary use with longwall shearer mining machinery, but can also be applied in situations where air diversion is necessary for the control of contaminants, and other airborne matter.

2. Description of the Prior Art

In longwall mining operations, such as coal mining, dust control and ventilation are critical to maintenance of machine operator safety. During mining operations, dust and harmful gas concentrations are generated, and if uncontrolled, will generally flow into the vicinity of the operator, thus creating a health hazard. Under current methods, removal of airborne matter such as dust and methane gas generated during mining operations is accomplished by either spraying the working area or under more complex procedures, by including in addition to a fluid spray, the inducement of an air flow that diverts the dust and gas away from the areas where it may accumulate. Examples of prior art which spray the working area with a dust suppressing medium are taught in U.S. Pat. No. 4,084,855 (R. C. Miles et al), and U.S. Pat. No. 2,693,950 (A. W. Calder). Examples of prior art which also include induced air flow as an additional means of dust suppression include U.S. Pat. No. 4,157,204 (F. N. Kissell et al) and U.S. Pat. No. 3,333,896 (J. J. Diamanti).

It has been taught that water sprays will induce air flow in the direction of the spray. U.S. Pat. No. 4,157,204 (F. N. Kissell et al) and U.S. patent application Ser. No. 870,162, Jan. 17, 1978, entitled "Ventilation System for Continuous Mining Machines," by F. N. Kissell and R. E. Wallhagen, describe in detail the use of fluid sprays to induce air flows. However, the prior art has concentrated on inducing air flow toward the front of the machine from the rear, across the working face, and then toward the rear on the side away from the operator to dilute the methane gas at the front of the machine. A different problem arises in longwall mining when there is a need to confine the dust cloud rather than forcing air forward to dilute gas. In longwall mining operations, the circular flow pattern characteristic of prior art will not be effective, and simply spraying the working face will not prevent significant amounts of dust from flowing into the area occupied by the machine operators.

The subject invention addresses this problem by providing a system whereby the fresh airstream approaching the machine is split into two separate portions, so that one portion flows to the area occupied by the operator while the other portion is directed by fluid sprays away from the operator, toward the working face and the longwall and thereafter on past the rear of the mining machine. These sprays also increase ventilation by inducing additional air flow across the longwall face as well as suppressing the amount of dust generated during the mining operation.

BRIEF SUMMARY OF THE INVENTION

An air diversion and dust control system for longwall shearer mining machines which consists of support arms, curtain barriers, and a plurality of specifically oriented fluid sprays. The support arms are attached to the front and rear portions of the mining machine and are situated so as to provide horizontal supports level with the top of the mining machine body which project out from the ends of the body on the gob side of the machine. Attached to these support arms and extending downward near the mine floor are passive barrier curtains constructed of suitably stiff material, such that an air flow approaching from the front, or head end, of the machine will be split by the forward barrier curtain, with the rear curtain maintaining the separation of the split air streams. A plurality of fluid sprays are situated on the machine and the forward support arm and are oriented in such a manner as to assist in inducing part of the air stream to flow toward the coal face, on toward the rear, or tail end, of the machine, and finally exiting at the tail end of the machine on the side closest to the longwall face.

It is the object of this invention to split the air flow into two portions, one of which will supply the operators with fresh clean air and the other which will aid in movement of the dust generated during mine operations toward and along the longwall face away from the operators, and then exiting to the rear of the machine.

It is a further object of this invention to provide a means for the suppression of dust generated during mine operations.

It is still an additional object of this invention to provide a means for inducing and controlling air flow by means of a plurality of fluid sprays.

DETAILED DESCRIPTION OF THE PREFERRED EMBODIMENT

Figure 1:
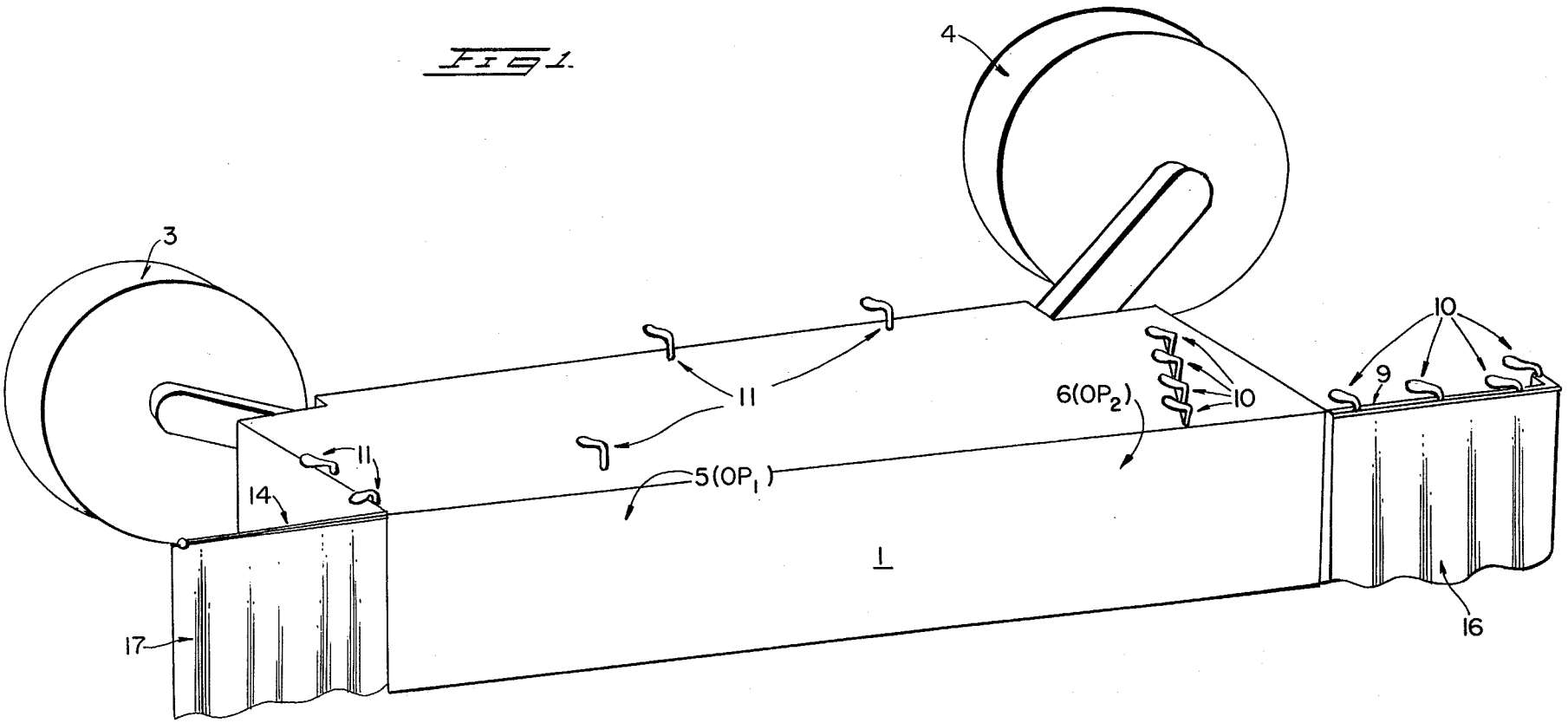
FIG. 1 depicts an isometric drawing of the preferred embodiment of the present invention.
Figure 2:
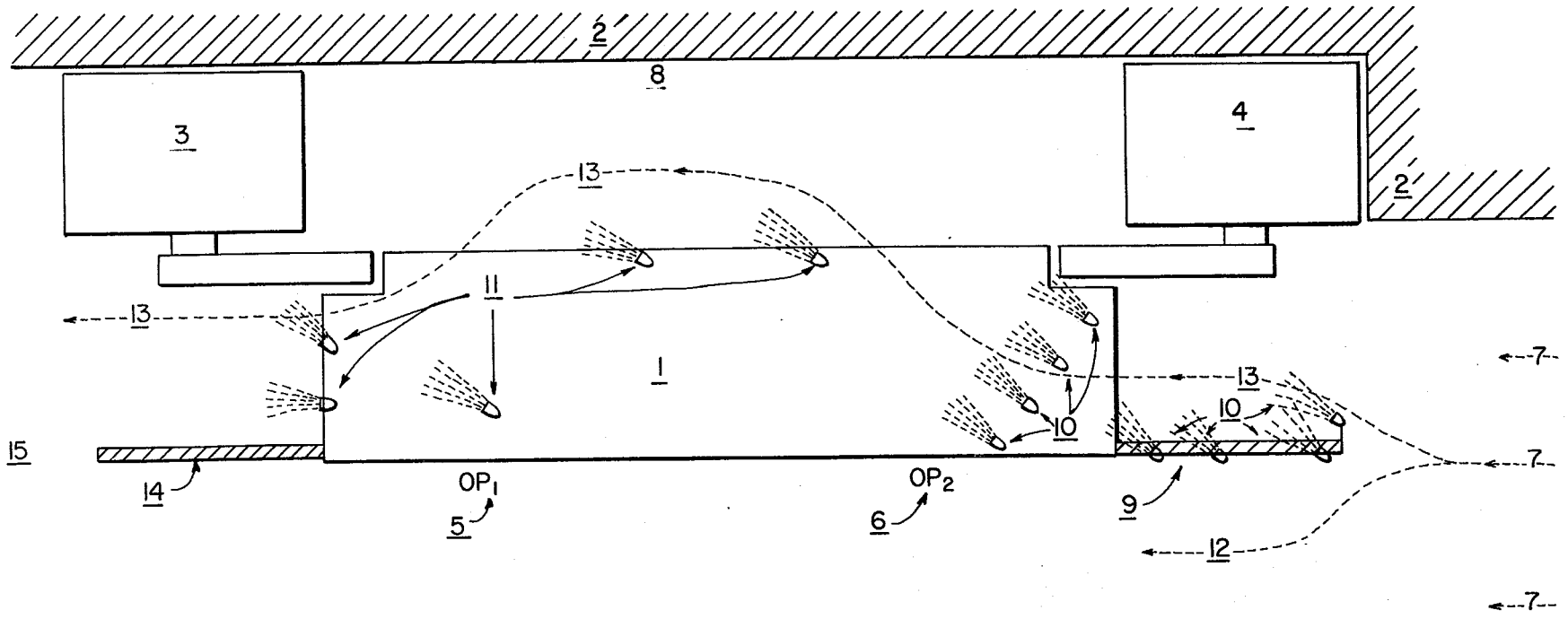
FIG. 2 is a plan view of the preferred embodiment of the present invention.

FIG. 2 is a plan view of a longwall shearer mining machine 1 engaged in the process of mining the coal bed 2. In this illustration, the machine is cutting from left to right, with the cutting action rendered by circular drums 3 and 4 which break the coal and load it onto a conveyor which passes under the body of the machine. As shown in FIGS. 1 and 2, drum 4 cuts the upper part of the coal bed while drum 3 cuts the remaining bench along the floor. The machine operators are located at positions designated by ($OP_1$) 5 and ($OP_2$) 6 as shown in FIGS. 1 and 2.

Also shown in the FIG. 2 is the direction of the air stream 7 moving from right to left along the longwall face. It can be seen that cutting drum 4 is upwind of both operators, and that the cloud of dust and gas streaming out in all directions from this drum will envelop the operators at positions 5 and 6.

The purpose of this invention is to provide a simple system by which the dust streaming out from drum 4 is inhibited from moving away from the drum in the direction transverse of the air stream, and to the greatest extent possible moved towards and confined to the freshly cut working face 8.

This is achieved by providing first, a support arm 9 which is extended from the forward corner of the operator's side of the shearer body horizontally, as shown in FIG. 1. A barrier 16 of a heavy flexible material is attached to this arm 9 and extended downward, and possibly upward, from said arm.

Second, a first bank of water sprays 10 is mounted on the top surface of the machine body 1 and support arm 9. These are oriented to spray in a direction downwind and towards the face 8 as indicated in FIG. 2.

Finally, a second bank of sprays is located at 11 and these are generally oriented in a downwind direction.

In experimental work performed to verify the feasibility of this system in performing its dual functions of inducing an air flow in the desired direction and leaching dust from the circulating air, the type of spray nozzle used was Nozzle Type BD20-2, manufactured by Spraying Systems Co., Wheaton, Ill.; however, any water spray nozzle with similar spray characteristics which will induce a sufficient quantity of air will function in this application.

The structural arrangement of the barrier curtain 16 and the spray heads 10 described above performs the objectives of the claimed invention by causing the air stream 7, which is moving from right to left along the working face 8, to be split into two separate streams 12 and 13 as a result of the intervention of the support arm 9 and barrier curtain 16 extending downward from it. The air stream 12 on the side away from the face 8 does not accumulate any dust and passes directly into the breathing zones of the operator(s). The air stream 13 passes between arm 9 and drum 4 accumulating dust which is thrown out by drum 4. Dusty air stream 13 is then induced by the air moving characteristics of sprays 10 to move in the direction of face 8, as indicated in FIG. 2. Sprays 10 and 11 actually cause air stream 13 to increase in velocity. This increased velocity causes the cross section of air stream 13 to decrease, thereby preventing its spreading into the area where the operators are located. Stream 13 moves from right to left along face 8 where it is then diverted around drum 3 by the action of spray bank 11. The continued downwind separation of the clean and dusty air streams 12 and 13, is further enhanced by incorporating a support arm 14, which is extended from the aft corner of the shearer body, as shown in FIG. 1, and barrier curtain 17. It is also possible to futher improve the effectiveness of the system, particularly in severely dusty conditions, by the addition of further air stream directing barriers 15 which may be extended from support arm 14 in a downwind direction 15 to maintain the separation of the clean and dusty air streams, thereby protecting other individuals working downwind of the shearer.

We claim:

1. In combination with a longwall mining machine having a main frame and a plurality of cutting heads extending laterally to one side of said main frame to engage the longwall of a mine and remove coal therefrom, said cutters located adjacent to the fore and aft portions of said main frame, the improvement comprising an air flow and dust suppressant system including:

(a) a first air flow control means mounted on said main frame and projecting beyond the forward portion thereof, and (b) a second ambient air flow control means dispersed across the top of said main frame, said second means discharging a dust-suppressing fluid into the air in a direction toward the longwall surface and toward the aft portion of said machine, whereby causing the ambient air to flow in generally parallel paths to either side of said machine and then on past said machine; with the path of flow adjacent the mine wall carrying a concentration of the dust and machine gas generated during the mining operation, while the second parallel air flow path remaining virtually free of dust.

2. The air movement and ventilation system of claim 1 wherein the first air flow control means is comprised of a curtain assembly mounted on said machine so as to split the fresh air flow into two portions, wherein the first portion flows across the mining machine toward the working face and away from the machine operator's stations, and a second parallel portion that flows directly to the areas immediately adjacent to the machine operator's stations.

3. The air movement and ventilation system of claim 1 wherein the curtain assembly is comprised of in combination:

(a) a support arm separately mounted on the mining machine so as to extend beyond the forward portion of the operator's side of the mining machine body, and (b) a barrier curtain constructed of suitably stiff material attached to and suspended from the support arms and extending downward to a point near the mine floor.

4. The air movement and ventilation system of claim 1 wherein the second ambient air control means consists of a plurality of fluid sprays mounted on said mining machine and said air splitting means; arranged and oriented in such a manner as to induce and accelerate the air flow past the area of the working face, along the sidewall and thereafter past the rear of the mining machine.

5. The combination as defined in claim 1 including a further air flow control means extending above and rearwardly of the aft portion of said continuous mining machine.

6. The combination as defined in claim 5 where said further air control means is comprised of in combination:

(a) a support arm mounted on the mining machine so as to extend past the aft portion of the operator's side of the mining machine body, and (b) a barrier curtain constructed of suitably stiff material attached to and suspended from said support arms and extending downward to a point near the mine floor.

* * * * *